US011435154B2

(12) United States Patent
Ervin

(10) Patent No.: US 11,435,154 B2
(45) Date of Patent: Sep. 6, 2022

(54) REMOVABLE FIREARM CHAMBER-OBSTRUCTION MECHANISM AND METHODS THEREOF

(71) Applicant: Dylan S. Ervin, Spokane Valley, WA (US)

(72) Inventor: Dylan S. Ervin, Spokane Valley, WA (US)

( * ) Notice: Subject to any disclaimer, the term of this patent is extended or adjusted under 35 U.S.C. 154(b) by 0 days.

(21) Appl. No.: 17/354,571

(22) Filed: Jun. 22, 2021

(65) Prior Publication Data

US 2022/0090874 A1 Mar. 24, 2022

Related U.S. Application Data

(60) Provisional application No. 63/042,239, filed on Jun. 22, 2020.

(51) Int. Cl.
*F41A 17/44* (2006.01)
*F41A 17/04* (2006.01)

(52) U.S. Cl.
CPC ..... *F41A 17/44* (2013.01); *F41A 17/04* (2013.01)

(58) Field of Classification Search
CPC ..... F41A 17/04; F41A 17/44
See application file for complete search history.

(56) References Cited

U.S. PATENT DOCUMENTS 5,189,894 A * 3/1993 Buck ..... E05B 37/16 70/351
5,398,438 A * 3/1995 Williams ..... F41A 17/04 42/70.11
5,664,358 A * 9/1997 Haber ..... F41A 17/44 42/70.11
6,560,910 B1 * 5/2003 McLaren ..... F41A 17/04 42/70.11
6,591,532 B1 * 7/2003 Gilbertson ..... F41A 17/42 42/70.11
6,755,059 B1 * 6/2004 Nall ..... F41A 17/04 70/25
2002/0133999 A1 * 9/2002 Polenz ..... F41A 17/44 42/70.11
2004/0118172 A1 * 6/2004 Nall ..... E05B 37/166 70/298
2017/0350667 A1 * 12/2017 Fishbein ..... F41A 17/063
2017/0356711 A1 * 12/2017 Lessard ..... F41A 17/44
2020/0072570 A1 * 3/2020 Sun ..... F41A 17/44
2021/0071973 A1 * 3/2021 Weiss ..... F41A 17/64

* cited by examiner

*Primary Examiner* — Joshua E Freeman
(74) *Attorney, Agent, or Firm* — Lee & Hayes, P.C.

(57) ABSTRACT

A removable firearm chamber-obstruction mechanism includes a locking mechanism including at portion configured to be inserted in a chamber of a firearm and engage the chamber so as to be locked in place. The locking mechanism includes one or more finger actuators, a thumb bar actuator engaged with the one or more finger actuators, a release key connected to the thumb bar actuator, and a tooth key disposed in abutment against the release key. A handle covers the locking mechanism, and a lid encloses the handle. The locking mechanism locks and unlocks the tooth key upon a successful manual actuation of the one or more finger actuators and the thumb bar actuator, such that the tooth key engages the chamber in a locked position and is unengaged from the chamber in an unlocked position.

2 Claims, 10 Drawing Sheets

FULL ASSEMBLY

BACK

RIGHT

TOP

FRONT

LEFT

PART LIST

| ITEM | QTY | NAME | SHEET |
|---|---|---|---|
| 1 | 1 | HANDLE | 3 |
| 2 | 1 | FINGER ACTUATORS | 4 |
| 3 | 1 | THUMB BAR ACTUATOR | 5 |
| 4 | 1 | LID | 6 |
| 5 | 1 | TOOTH KEY | 7 |
| 6 | 1 | RELEASE KEY | 8 |

THUMB BAR ACTUATOR

TOOTH KEY

RELEASE KEY

SECTION B-B
SCALE 2:1

RELEASE KEY/TOOTH KEY/THUMB
BAR ACTUATOR OPEN ACTION

REMOVABLE FIREARM CHAMBER-OBSTRUCTION MECHANISM AND METHODS THEREOF

RELATED APPLICATIONS

This application claims priority to U.S. Provisional Application No. 63,042,239, filed Jun. 22, 2020, and incorporates the entirety of the contents therein. Furthermore, this application incorporates by reference the subject matter of U.S. application Ser. No. 16/137,173, submitted by the same inventor of the instant application, with particular attention to the structure of the locking keys (finger actuators) and the functionality thereof.

BACKGROUND

Valuable personal items that are portable, when not in regular use, are frequently stored for safekeeping within a safe or home vault. The items one stores vary widely from one individual to the next, including jewelry, currency, weapons, electronics, etc. Modern safes are often fireproof, heavy, relatively large, and sometimes fixed in place. To further enhance security, in many cases, a safe or home vault is kept out of sight and located in a remote area or less trafficked area of a residence to minimize visibility to potential intruders or burglars. Additionally, safes and home vaults generally require a key and/or entry of a security code to access the contents therein. Despite the general acceptance of the safekeeping aspects of a safe or home vault, in some instances, one may desire to temporarily maintain an item in a more convenient location when at home, work, or even on travel for quicker, easier, or more readily available access. Furthermore, regardless of the intrinsic value of an item, an individual may desire to maximize personal accessibility to the item while restricting easy access to the item to others, particularly to children who may not take proper care of the item.

As one example of items stored, firearms are often stored in gun safes to protect against theft, damage, and/or unauthorized use. Additionally, in some instances, firearms may be stored or secured in a way that minimizes their risk of accidental harm. For instance, firearms may be kept in a closet, basement, and/or other locations not readily accessible. Additionally, long-barrel firearms and even some short-barrel firearms may have locking or risk-minimizing devices engaged with or through the chamber of the particular firearm. Such devices function as chamber-obstruction mechanisms to prevent a round from being loaded in the chamber and discharged. Further, such chamber-obstruction mechanisms typically still require an additional and separate key or tool to remove the mechanism from engagement in the chamber in order to make the firearm functional. However, in times of emergency, storing firearms with such chamber-obstruction mechanisms, let alone in gun safes and/or hard to reach places, limits the rapid utility of the firearm. For instance, there may be little time to locate a key or tool to remove a chamber-obstruction mechanism from a firearm, and/or additionally locate a key or enter a security code to unlock a gun safe before accessing a firearm.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict the same components on a larger scale or differently shaped for the sake of clarity.

DETAILED DESCRIPTION

Overview

This disclosure is directed to a chamber-obstruction mechanism that is a locking retention device. The chamber-obstruction mechanism is configured to be inserted into the chamber of a firearm to block a round from entering the barrel, prevent the bolt/action of the firearm from closing, and also blocking the firing pin from reaching the primer of a round.

The chamber-obstruction mechanism disclosed herein may prevent an unauthorized and/or uninformed (of the required finger actuator pattern) user from chambering a round into the firearm, while allowing an authorized and informed user to quickly access the firearm. By pressing a preconfigurable finger combination a user may unlock, insert, lock, unlock, and remove the chamber-obstruction mechanism.

The functionality and sizing of the chamber-obstruction mechanism as disclosed herein is applicable and scalable to be functional in a variety of firearms. For example, in an embodiment, the chamber-obstruction mechanism may be sized to engage the chamber of an AR-15 rifle chambered for either .223 REM or 5.56 NATO, a .22 rifle, a .308 rifle, a shotgun of varying gauges, pistols of varying calibers, etc.

A chamber-obstruction mechanism may be constructed out of any suitable material. For example, the material may be sufficiently durable to provide resistance to collapse of the external shell (i.e., the handle and/or lid) of the chamber-obstruction mechanism, when grasped and the figure actuators and thumb bar actuator are actuated by a user. It is understood that all materials have natural property strength characteristics. Accordingly, the material(s) for the chamber-obstruction mechanism are selected to have compression, tension, shear, and torsion strengths greater than the strength of an average adult. In an embodiment, materials such as aluminum and Polycarbonate-ABS are contemplated.

Illustrative Embodiments of a Chamber-Obstruction Mechanism

Figure 1:
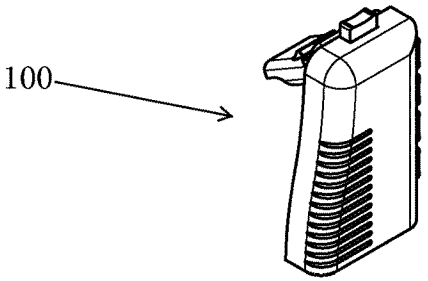
FIG. 1 illustrates an isometric view of a chamber-obstruction mechanism according to an embodiment of the instant disclosure.

FIG. 1 illustrates a perspective view of the fully assembled chamber-obstruction device 100.

Figure 2:
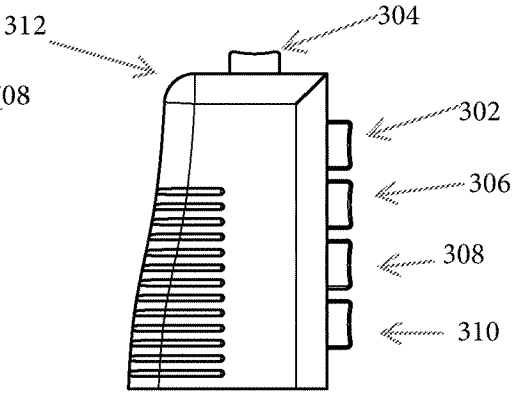
FIG. 2 illustrates a front view of the chamber-obstruction mechanism in FIG. 1, according to an embodiment of the instant disclosure.

FIG. 2 illustrates a front view of the chamber-obstruction device 100. The finger actuators 302, 306, 308, and 310 are connected to the housing 312. Each of the finger actuators may protrude beyond a perimeter or exterior of the housing defined by chamber-obstruction device 100. The thumb bar actuator 304 may protrude beyond a perimeter or exterior of the housing defined by the chamber obstruction device 100. The thumb bar actuator 304 may protrude from the top of the housing 312, whereas the finger actuators may protrude from the right side of the protective housing 312.

Figure 3:
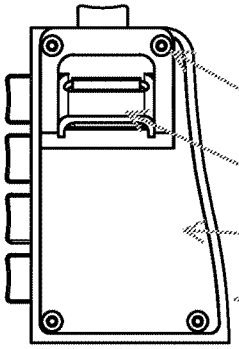
FIG. 3 illustrates a back view of the chamber-obstruction mechanism in FIG. 1, according to an embodiment of the instant disclosure.

FIG. 3 illustrates a back view of the chamber-obstruction device 100. Here, the lid 408 is connected to the protective housing 406 via fasteners 402 through the lid 408 to the protective housing 406.

Figure 4:
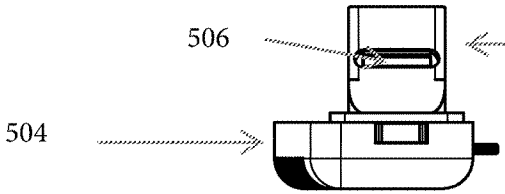
FIG. 4 illustrates a top view of the chamber-obstruction mechanism in FIG. 1, according to an embodiment of the instant disclosure.

FIG. 4 illustrates a top view of the chamber-obstruction device 100. A flange 502 is connected to and protrudes away from the housing 504. Further, FIG. 4 shows the aperture 506 within the flange 502 where a tooth key may protrude. In an embodiment, the flange 502 is inserted into the chamber of an AR-15 rifle chambered for either .223 REM or 5.56 NATO, a .22 rifle, a .308 rifle, a shotgun of varying gauges, pistols of varying calibers, etc. While inserted in the chamber of the firearm, the tooth key will protrude through the aperture to lock the chamber-obstruction device in the chamber of the rifle.

Figure 5:
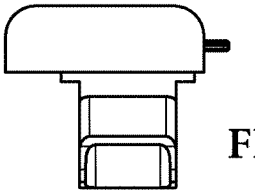
FIG. 5 illustrates a bottom view of the chamber-obstruction mechanism in FIG. 1, according to an embodiment of the instant disclosure.

FIG. 5 illustrates a bottom view of the chamber-obstruction device 100.

Figure 6:
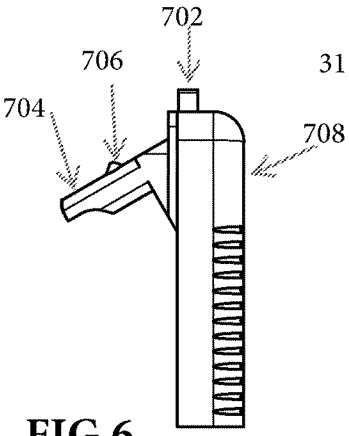
FIG. 6 illustrates a left side view of the chamber-obstruction mechanism in FIG. 1, according to an embodiment of the instant disclosure.

FIG. 6 illustrates a left view of the chamber-obstruction device 100. Flange 704 protrudes away at an angle from the protective housing 708. Further, the tooth key 706 may protrude from the aperture within the flange 706.

Figure 7:
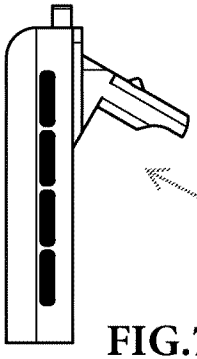
FIG. 7 illustrates a right side view of the chamber-obstruction mechanism in FIG. 1, according to an embodiment of the instant disclosure.

FIG. 7 illustrates a right view of the chamber-obstructed device 100.

Figure 8:
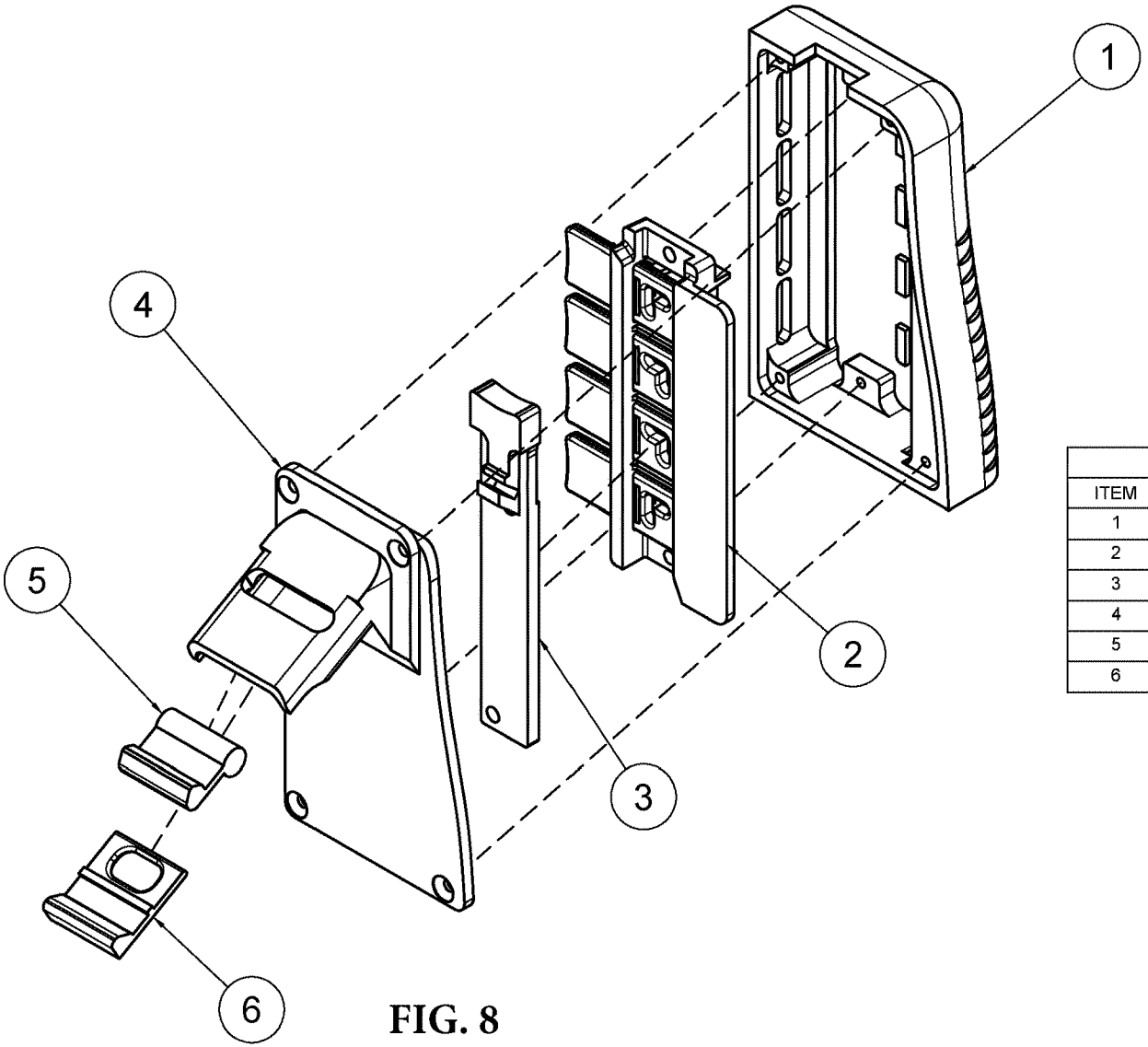
FIG. 8 illustrates an exploded assembly view of the chamber-obstruction mechanism in FIG. 1, according to an embodiment of the instant disclosure.
Figure 9:
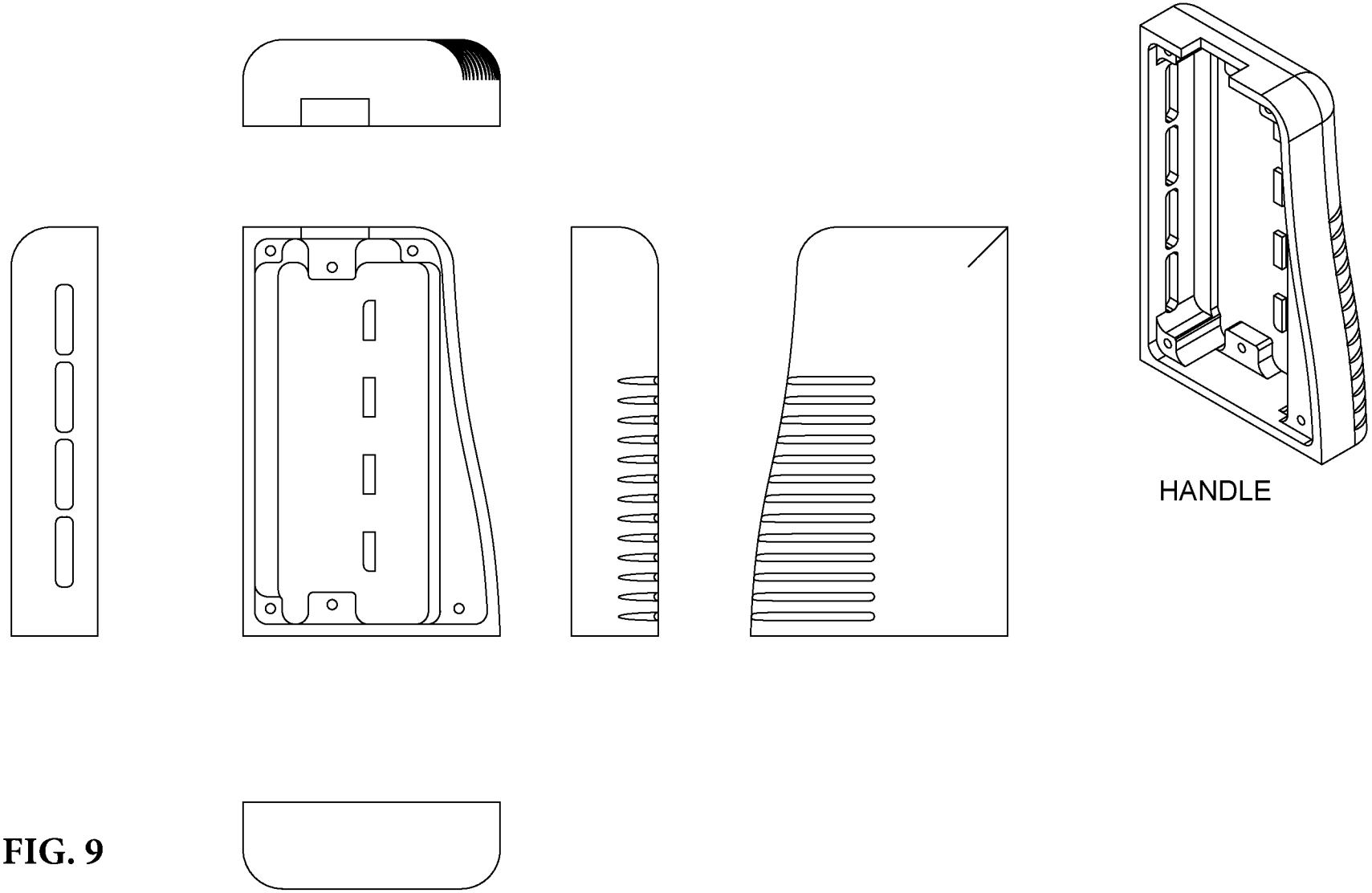
FIG. 9 illustrates various planar orientation views and an isometric view of the handle of the chamber-obstruction mechanism in FIG. 1, according to an embodiment of the instant disclosure.
Figure 10:
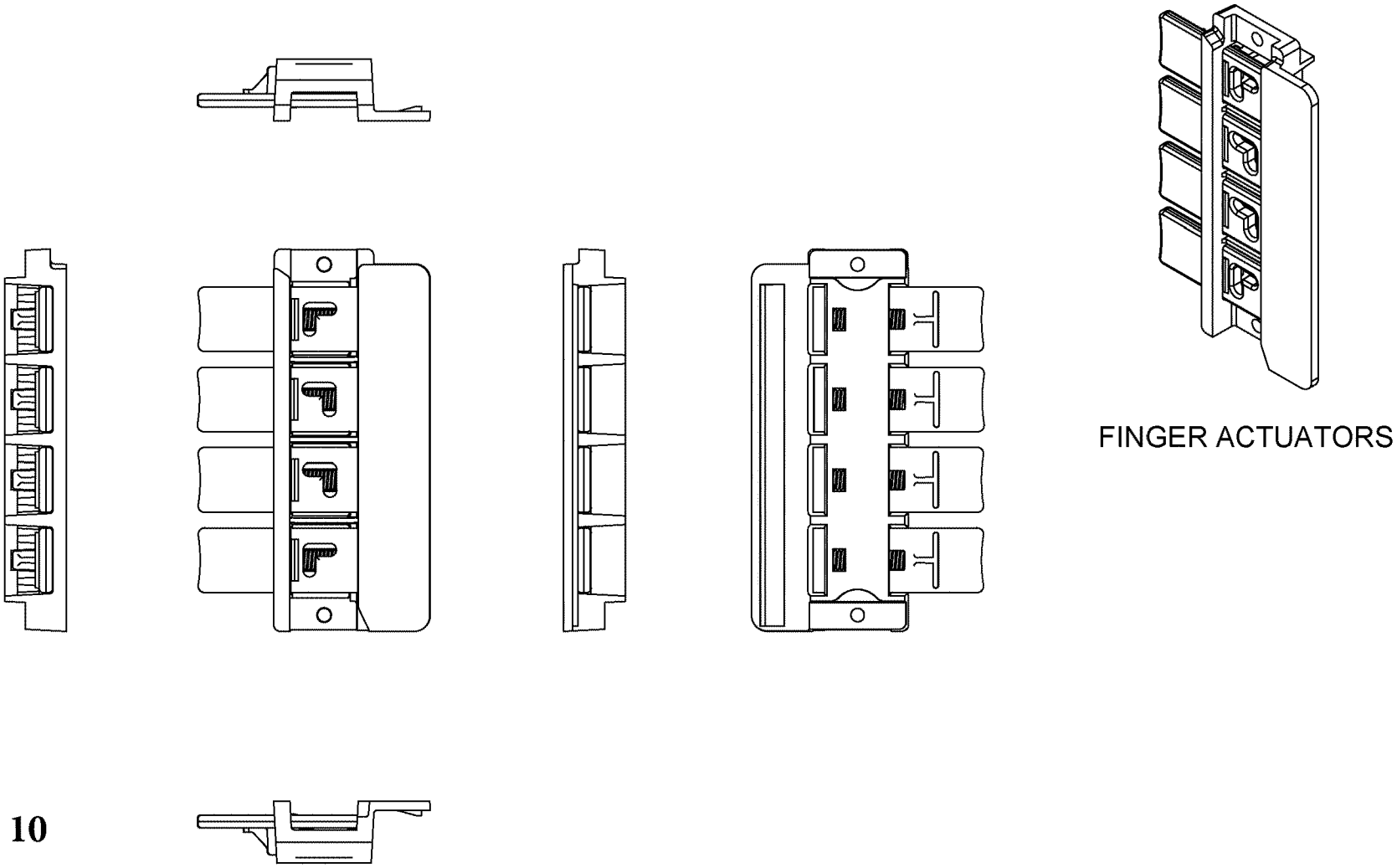
FIG. 10 illustrates various planar orientation views and an isometric view of the finger actuators of the chamber-obstruction mechanism in FIG. 1, according to an embodiment of the instant disclosure.

FIG. 8 illustrates the chamber-obstruction device 100 in layered view. A handle 1 may have a recess, as depicted, extending into the handle housing. The handle 1 also has four voids on the side wall within which each of the finger actuators are placed. The top of the handle 1 may have a recess.

Further, the finger actuators 2 are displayed. The finger actuators 2 are disposed in the recessed protrusion of the handle 1 so that the one or more finger actuators protrude through the perimeter of the handle housing 1. After the finger actuators are placed within the handle 1, the thumb bar actuator 3 is then placed against, and in contact with, the finger actuators 2. As described above, the thumb bar actuator 3 protrudes from the top of the chamber-obstruction device 100, which is from the top of the handle 1. See U.S. application Ser. No. 16/137,173 for more details regarding the actuation of the locking finger actuators.

The lid 4 may be placed in part against, and in contact with, the thumb bar actuator 5. The majority of the lid 4 may be placed against the handle 1. The lid 4 may be connected to the handle 1 via fasteners, such as machine screws or any other suitable type of fastening mechanism (e.g. sliding engagable protrusions/recessions, etc.). Disposed on the upper portion of the lid is the flange. The flange extends downward at an angle from the lid. The flange has an aperture within its surface through which the tooth key 5 may protrude.

The tooth key 5 is connected to the bottom of the flange. The release key 6 is placed in direct contact with the tooth key 5. The release key 6 is placed under the tooth key 5 to either keep the tooth key 5 in locked or open position.

While similarities to the material disclosed in related U.S. application Ser. No. 16/137,173, may exist with respect to the instant application, it is submitted that the similarities exist merely with respect to the type of access functionality that enables a user to unlock and to lock the chamber-obstruction mechanism disclosed. That is, the actuation of the actuation of the finger actuators and thumb bar actuators is similar. Nevertheless, the locking mechanism and function and capabilities are considered to be distinct.

In an embodiment, the finger actuators and thumb bar actuator as labeled on FIG. 8 may be configured to enable actuation of locking and unlocking positions according to a user's desire. For example, a user may configure the internal components of the finger actuators (see U.S. application Ser. No. 16/137,173) to enable a user to lock/unlock the chamber-obstruction mechanism in one of at least 10 combinations of two or more finger actuators depressed, where the thumb bar actuator is depressed as well.

Figure 11:
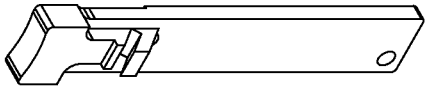
FIG. 11 illustrates various planar orientation views and an isometric view of the thumb bar actuator of the chamber-obstruction mechanism in FIG. 1, according to an embodiment of the instant disclosure.
Figure 11:
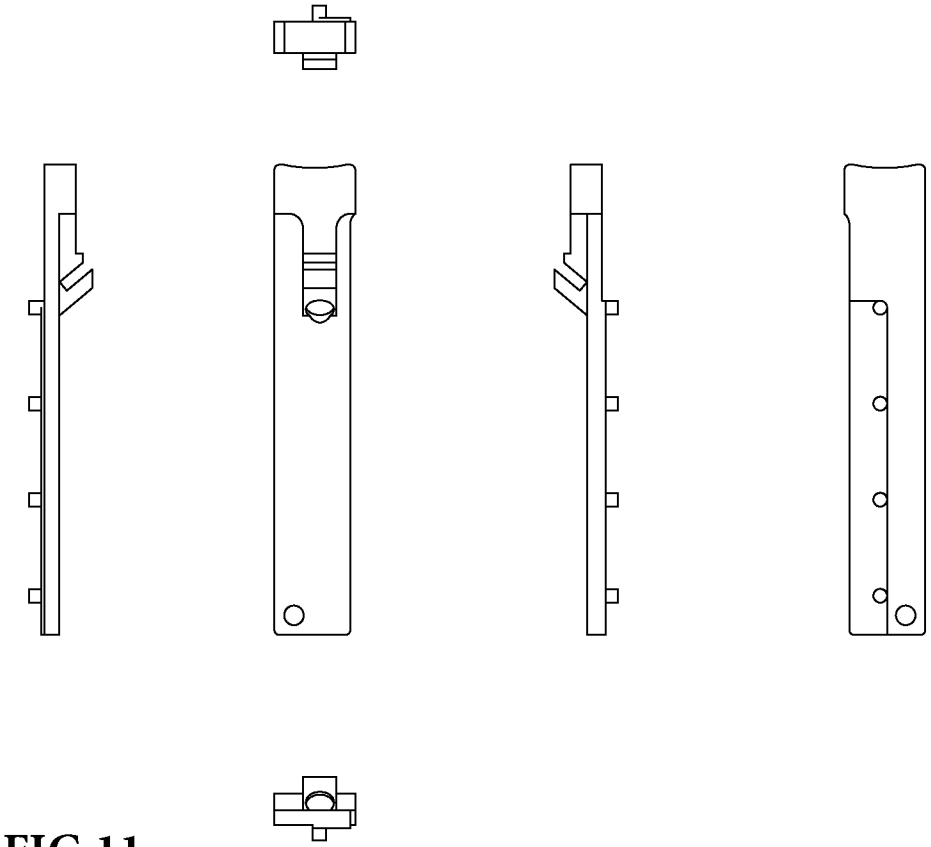
Figure 12:
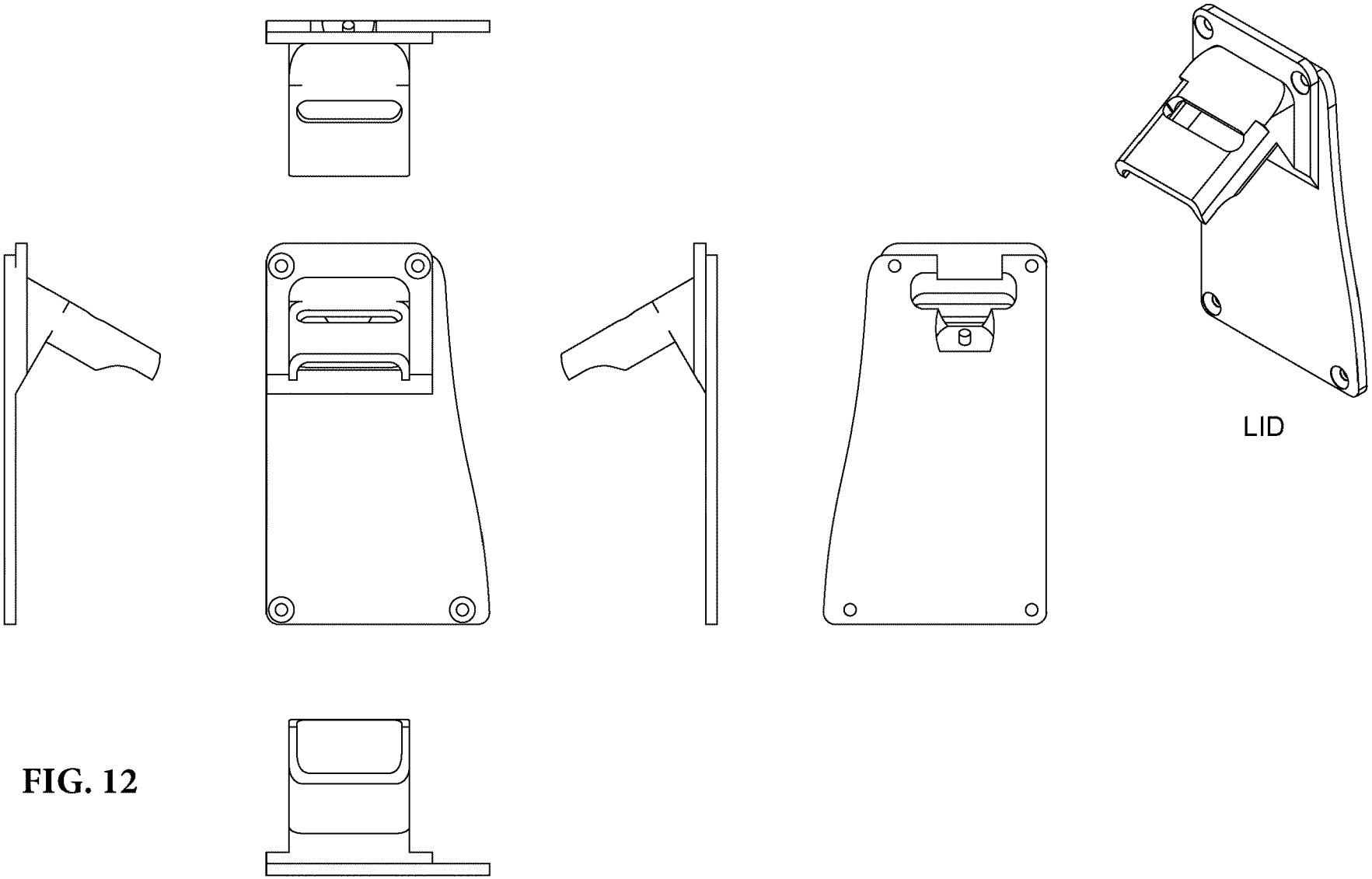
FIG. 12 illustrates various planar orientation views and an isometric view of the lid of the chamber-obstruction mechanism in FIG. 1, according to an embodiment of the instant disclosure.
Figure 13:
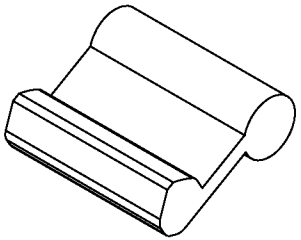
FIG. 13 illustrates various planar orientation views and an isometric view of the tooth key of the chamber-obstruction mechanism in FIG. 1, according to an embodiment of the instant disclosure.
Figure 13:
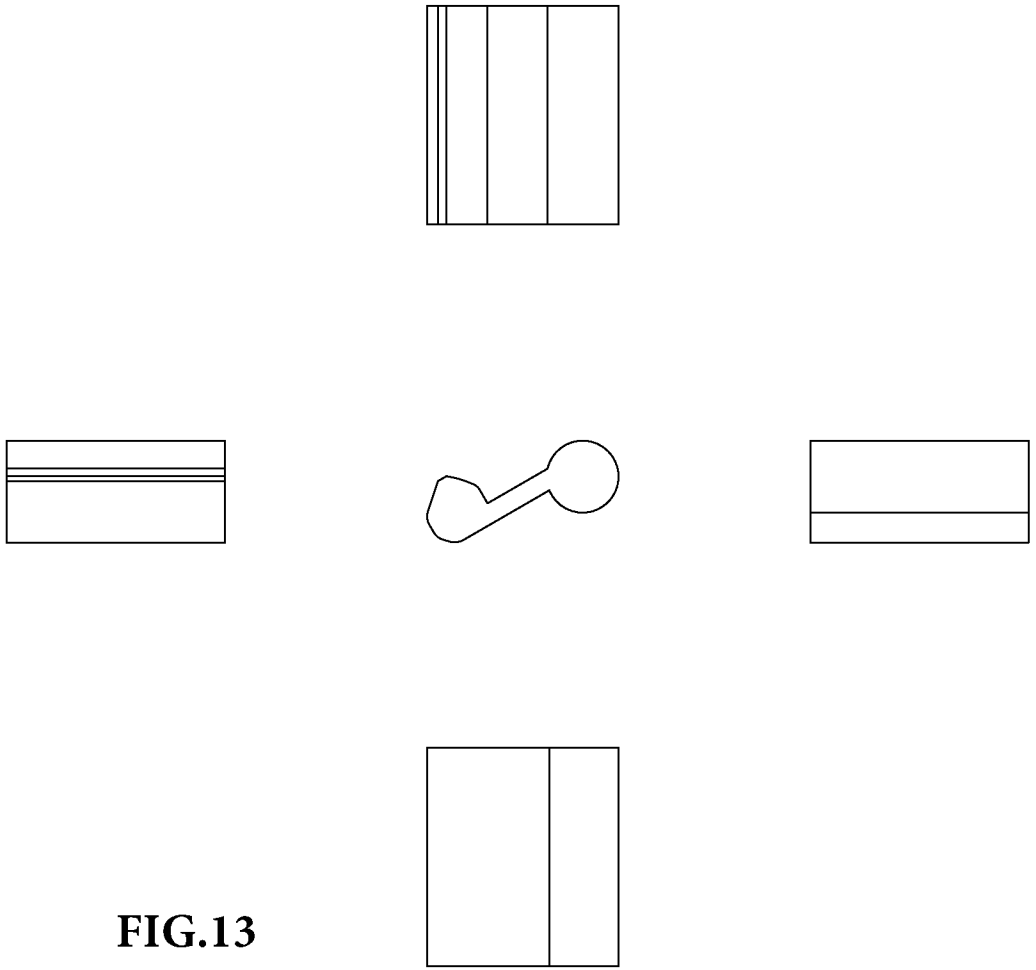
Figure 14:
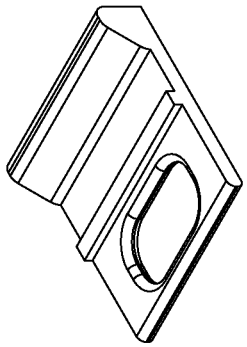
FIG. 14 illustrates various planar orientation views and an isometric view of the release key of the chamber-obstruction mechanism in FIG. 1, according to an embodiment of the instant disclosure.
Figure 14:
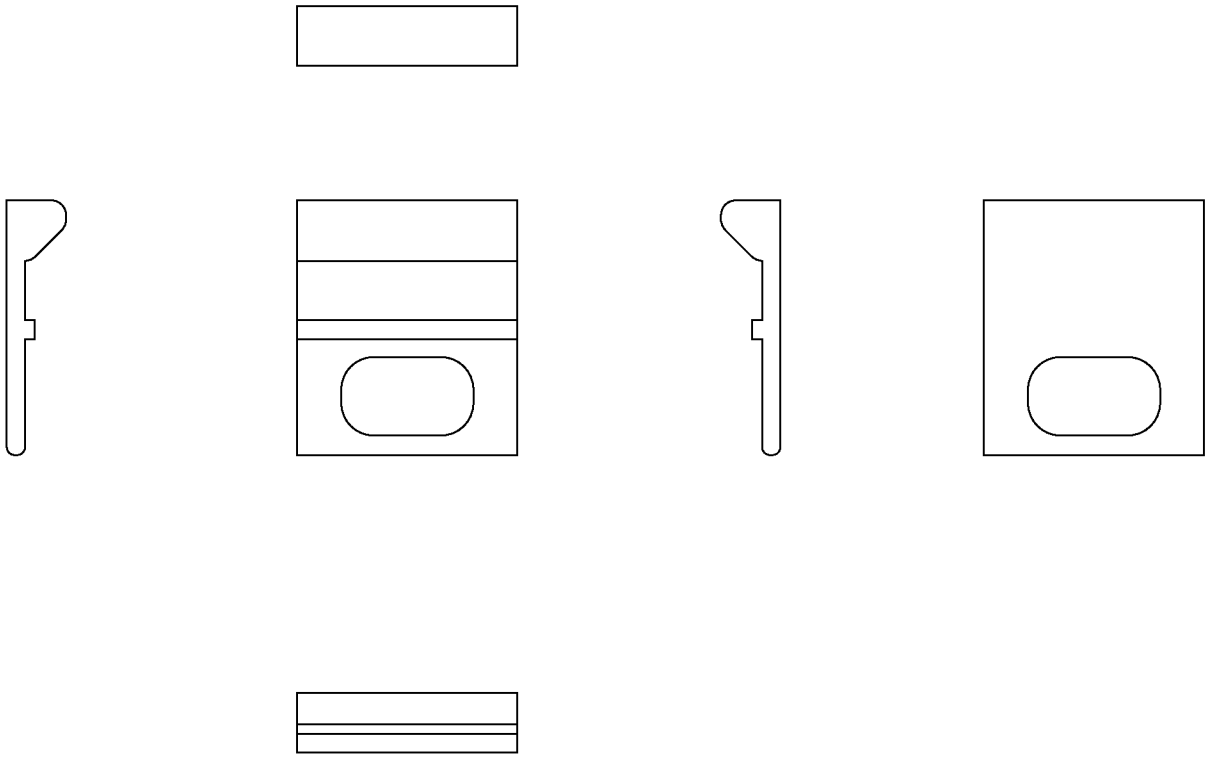
Figure 15:
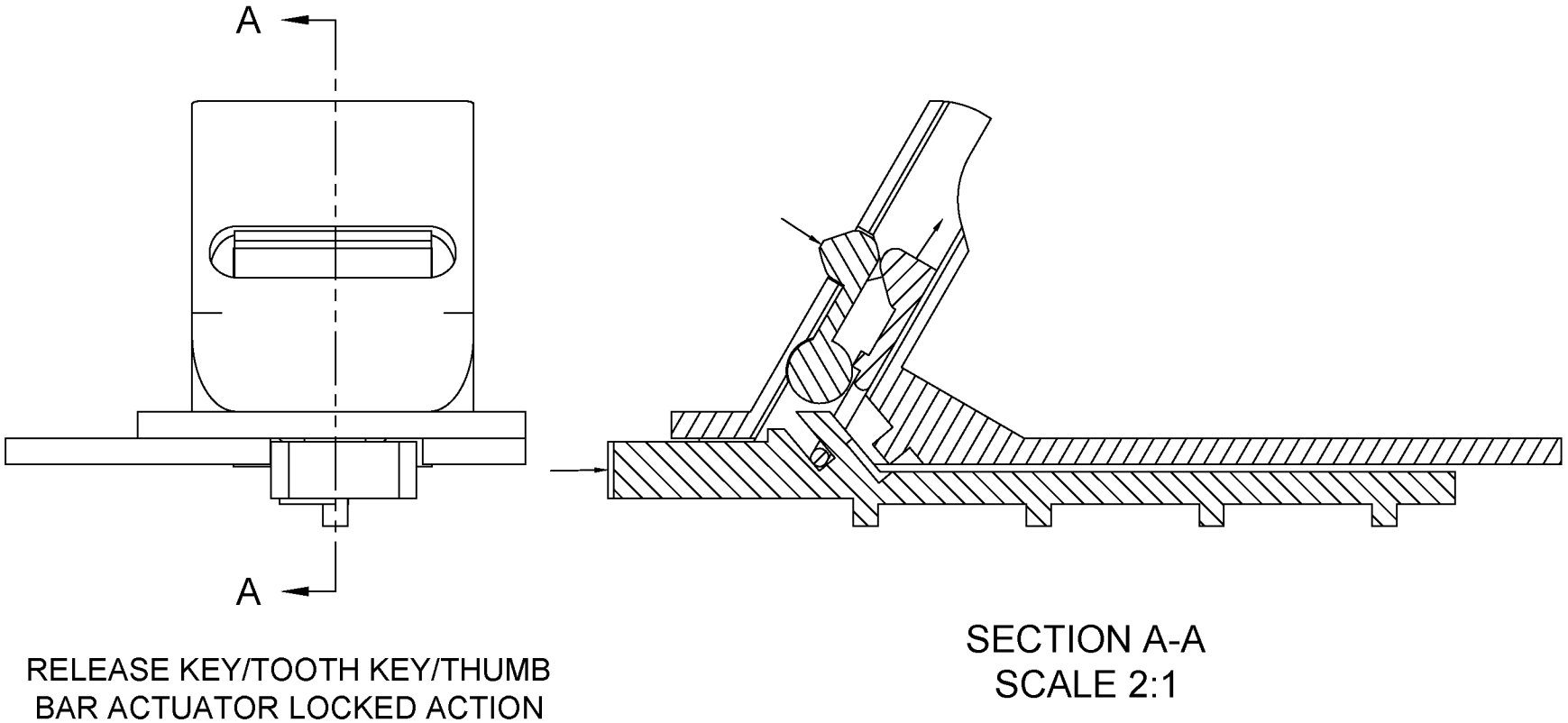
FIG. 15 illustrates a top planar view and a cross-sectional side (rotated from top) view thereof of the assembled thumb bar actuator, the lid, the tooth key, and the release key of the chamber-obstruction mechanism in FIG. 1, in the locked state, according to an embodiment of the instant disclosure.
Figure 16:
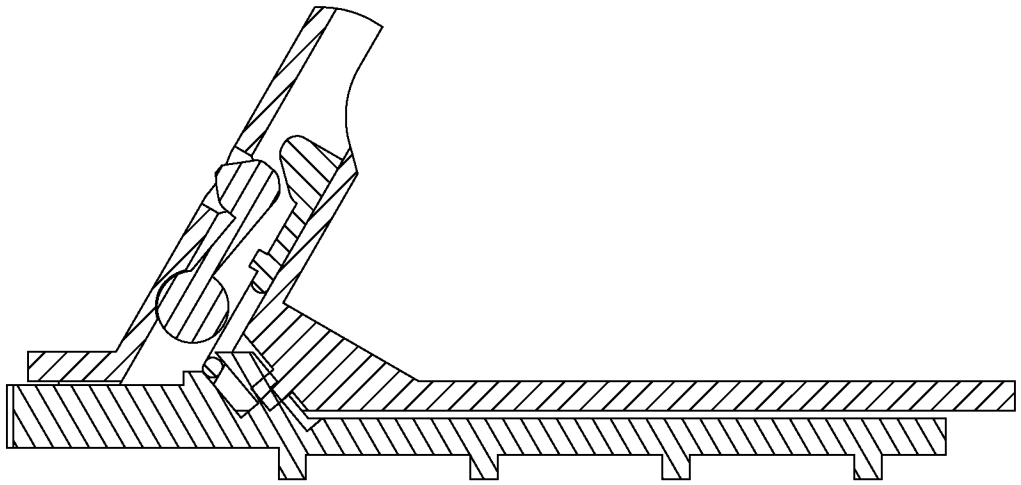
FIG. 16 illustrates a top planar view and a cross-sectional side (rotated from top) view thereof of the assembled thumb bar actuator, the lid, the tooth key, and the release key of the chamber-obstruction mechanism in FIG. 1, in the locked state, according to an embodiment of the instant disclosure.
Figure 16:
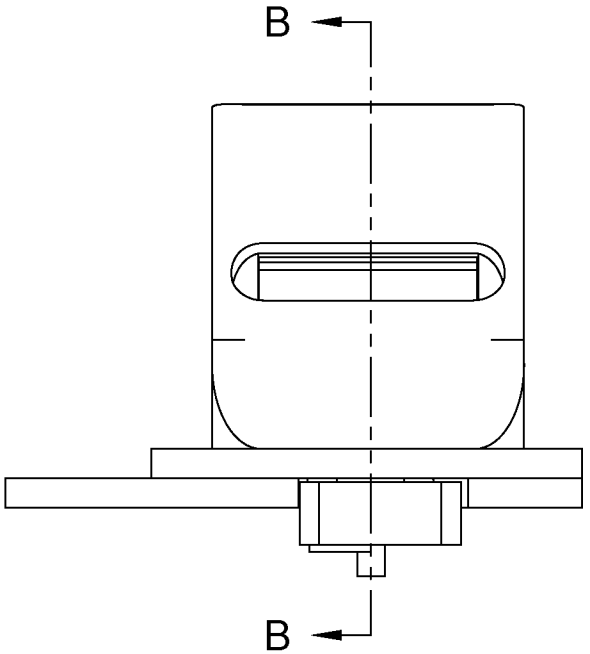

With respect to the actual locking function of the chamber-obstruction mechanism 100, upon a user compressing the appropriate, preconfigured finger actuators 302 and thumb bar actuator 304 (see FIG. 11), a capture groove on the thumb bar actuator 304 in which a captured portion of the release key 6 (see FIG. 14) is secured, will push the release key 6 and thereby cause the tooth key 5 (see FIG. 13)

to relax from a position pinned against an extended flange 502 of the lid 408 (see FIG. 12). When pinned against the flange 502, a tooth protrusion 706 on the tooth key 5 is forced to extend through an aperture in the flange 506, by compression from a protrusion of the release key 6, in which position it is locked (see FIG. 15). Thus, when the flange 502 on the lid 408 is being inserted in a chamber of a firearm, the thumb bar actuator 304 is depressed so as to relax the tooth key 5 and allow the protruding tooth 5 to slide below into the aperture 506 loosely. Thereafter, upon release of the thumb bar actuator 304, the thumb bar actuator 304 returns to an undepressed position, and the capture groove drags the release key 5 upward such that the protrusion on the release key 6 forces the tooth on the tooth key 5 to extend through the aperture 506 and engage an inner wall of the chamber in the firearm. Accordingly, the chamber-obstruction mechanism 100 may lock into place in the chamber of the firearm.

CONCLUSION

Although several embodiments have been described in language specific to structural features and/or methodological acts, it is to be understood that the claims are not necessarily limited to the specific features or acts described. Rather, the specific features and acts are disclosed as illustrative forms of implementing the claimed subject matter.

What is claimed is:

1. A removable firearm chamber-obstruction mechanism, comprising:

a locking mechanism including at portion configured to be inserted in a chamber of a firearm and engage the chamber so as to be locked in place, the locking mechanism including:

one or more finger actuators, a thumb bar actuator engaged with the one or more finger actuators, a release key connected to the thumb bar actuator, and a tooth key disposed in abutment against the release key;

a handle that covers the locking mechanism; and a lid to enclose the handle;

wherein the locking mechanism locks and unlocks the tooth key upon a successful manual actuation of the one or more finger actuators and the thumb bar actuator, such that the tooth key engages the chamber in a locked position and is unengaged from the chamber in an unlocked position.

2. The removable firearm chamber-obstruction mechanism of claim 1, wherein the one or more finger actuators protrude from a different side of the handle than the thumb bar actuator.

* * * * *